US007070134B1

(12) United States Patent
Hoyer

(10) Patent No.: US 7,070,134 B1
(45) Date of Patent: Jul. 4, 2006

(54) CENTRIFUGAL GRINDING MILLS

(75) Inventor: David Ian Hoyer, Pennant Hills (AU)

(73) Assignee: Hicom International PTY Limited, North Ryde (AU)

( * ) Notice: Subject to any disclaimer, the term of this patent is extended or adjusted under 35 U.S.C. 154(b) by 32 days.

(21) Appl. No.: 10/399,186

(22) PCT Filed: Oct. 16, 2000

(86) PCT No.: PCT/AU00/01255

§ 371 (c)(1),
(2), (4) Date: Oct. 28, 2003

(87) PCT Pub. No.: WO01/30502

PCT Pub. Date: May 3, 2001

(30) Foreign Application Priority Data

Oct. 21, 1999 (AU) ..... PQ 3555

(51) Int. Cl.
*B02C 18/18* (2006.01)

(52) U.S. Cl. ..... 241/171; 241/175

(58) Field of Classification Search ..... 241/171, 241/172, 175
See application file for complete search history.

(56) References Cited

U.S. PATENT DOCUMENTS

| | | | | |
|---|---|---|---|---|
| 4,739,936 | A * | 4/1988 | Stehr | 241/69 |
| 4,742,966 | A * | 5/1988 | Szkaradek et al. | 241/69 |
| 5,105,848 | A | 4/1992 | Kallenbach | |
| 5,363,877 | A | 11/1994 | Frentzel et al. | |
| 5,364,036 | A * | 11/1994 | Falcon-Steward | 241/21 |
| 5,682,624 | A | 11/1997 | Ciochetti | |
| 5,991,939 | A | 11/1999 | Mulvey | |
| 6,098,654 | A | 8/2000 | Cohen et al. | |
| 6,105,890 | A * | 8/2000 | Rayner | 241/179 |

FOREIGN PATENT DOCUMENTS

| | | |
|---|---|---|
| WO | WO 86/00825 | 2/1986 |
| WO | WO 99/59723 | 11/1999 |
| WO | WO 00/12215 | 3/2000 |

* cited by examiner

*Primary Examiner*—Mark Rosenbaum
(74) *Attorney, Agent, or Firm*—Paul T. Clark; Clark & Elbing LLP

(57) ABSTRACT

The present invention relates to a centrifugal grinding mill comprising a vertical axis of revolution (1), a nutating axis (2) intersecting axis (1) at a point of nutation symmetry (3), a grinding chamber (4) symmetrical about axis (2) connecting with feed passage (5) at its upper end and having discharge openings (6) of a screening element (26) located within a plane area aligned normal to, symmetrical with, and intersected by the axis (2), and adjacent the plane containing the maximum diameter of the grinding chamber (4).

23 Claims, 6 Drawing Sheets

CENTRIFUGAL GRINDING MILLS

CROSS-REFERENCE TO RELATED APPLICATIONS

This application is the National Stage of International Application No. PCT/AU00/01255, filed Oct. 16, 2000, which was published in English under PCT Article 21(2). This application also claims benefit of Australian Provisional Application No. PQ3555.

FIELD OF THE INVENTION

The present invention relates generally to centrifugal grinding mills and relates particularly, though not exclusively, to centrifugal grinding mills which perform the size reduction of solid particles by the action of loose grinding media which are driven with a gyrating and tumbling motion.

BACKGROUND TO THE INVENTION

Centrifugal grinding mills have been widely applied for the comminution of solid particles, in particular for the size reduction of mineral ores. A feature of centrifugal grinding mills is that the centrifugal acceleration imparted to the mill contents as a consequence of their gyrating motion has the effect of greatly enhancing the rate of comminution compared with conventional tumbling mills, which are limited by gravitational acceleration.

A particular type of centrifugal grinding mill to which this invention relates is that in which the grinding chamber axis is inclined to and intersects the axis of rotation of the chamber, which is characteristic of nutating motion. For the purpose of this specification nutating motion of a machine element relative to a fixed frame is defined as the motion of the element, an axis of which intersects with and traces out a conical surface about a stationary axis of the fixed frame. In the general case, the nutating element has a net rotational motion about its axis, relative to the fixed frame. A special case of nutating motion is one in which the nutating element has a net irrotational motion.

FIGS. 1 and 2 show cross sections through known centrifugal grinding mills of this type, such as that described in the specifications accompanying International Patent Application No. PCT/AU99/00695, and Australian Patent No. 568949. The figures shows a grinding chamber 104, having an axis of symmetry 102, which rotates about a fixed axis 101, and intersects therewith at a point of nutation symmetry 103. The chamber is constrained to perform nutating motion by the engagement of complementary annular bearing surface pairs 109 and 111, and 108 and 110, which together form a spherical bearing symmetrical about the point of nutation symmetry 103, and which limit the amplitude of nutating motion. Feed material, in the form of coarse granular material 131, as a suspension of coarse particles in a fluid, or as a combination of both of these alternatives, enters the grinding chamber from the feed passage 105, and discharges from the opposite extremity of the grinding chamber via openings 106, as a fine granular product. In the embodiment shown in FIG. 1, the grinding chamber 104 is driven with a nutating motion about stationary axis 101 by multiple pistons 159 which are driven in phased sequence and bear against a flanged extension of the grinding chamber located about the point of nutation symmetry 103. In the embodiment shown in FIG. 2, the grinding chamber is driven with a nutating motion by shaft 114, which connects with electric motor 115 at one end, and engages with the end of chamber 104 through an eccentric stub shaft 119, attached to the other end.

It is a characteristic of these types of grinding machines that production of coarse and intermediate sizes product material requires the use of grinding media 132 having a size of typically 5 to 20 mms spherical diameter, which is larger than the size of discharge openings 106 in the wall of the chamber 104. Particles of grinding media are thus contained within the chamber, and only particles of feed material, or worn grinding media, having a size smaller than the openings 106, can discharge from the chamber. Production of very fine product material, typically having 80 percent finer than 40 microns, requires the use of correspondingly fine grinding media, typically 1 to 5 mm spherical diameter, for minimum energy consumption. The use of correspondingly small discharge openings 106 in the periphery of the grinding chamber 104 is not feasible. It has been found from experience that centrifugal grinding machines having discharge openings of the type shown in FIGS. 1 and 2 are unsuited to production of very fine product. As the size of discharge opening is reduced, the likelihood of blockage by oversize particles increases inversely with the size of discharge opening. Furthermore, the very high surface pressures at the internal surface of the grinding chamber is not compatible with the structural or wear requirements of very fine discharge apertures.

SUMMARY OF THE INVENTION

According to the present invention there is provided a centrifugal grinding mill comprising:

a grinding chamber having a longitudinal axis of symmetry, the grinding chamber being constrained and adapted to permit nutating motion of the axis of symmetry about a relatively stationary axis of the grinding mill, said axes intersecting at a point of nutation symmetry;

a support member on which the grinding chamber is supported;

a feed passage in communication with and directed towards the grinding chamber;

driving means operatively coupled to the grinding chamber, and designed to drive the grinding chamber to effect the nutating motion; and a screening element located internally of the grinding chamber and being configured to permit particles of ground product to discharge from the chamber.

Generally the screening element includes a screening surface oriented substantially normal to the longitudinal axis of the grinding chamber wherein ground product is discharged from the chamber in a generally axial direction. This discharge from the grinding chamber in an axial direction requires that discharge occurs in a region adjacent the axis of symmetry of the chamber. This is a region associated with reduced impact pressures and corresponding reduced abrasive wear, compared with the periphery of the chamber in which discharge occurs in the prior art machine.

Preferably, the screening element includes a member having a perforated area disposed symmetrically about the axis of symmetry of the grinding chamber. More preferably, the screening element includes a planar member having a perforated plane area aligned normal to, and symmetrical with, the axis of symmetry of the grinding chamber. A consequence of this specific geometry of the perforated plane area, containing discharge openings, is that motion of grinding media and feed material is substantially parallel with the surface of the plane area. Hence contact pressures, and corresponding abrasive wear at the plane area surface, are relatively low.

In both prior art machines described herein, the discharge openings are contained in the peripheral wall of the chamber, which provide containment of the chamber contents, and resist all inertial forces resulting from their gyrating motion. Surface contact pressures, and associated abrasive wear conditions in this configuration of discharge openings are very high.

It is a feature of a preferred embodiment of the invention that the perforated area of the screening element is located symmetrically about the axis of symmetry of the grinding chamber, and approximately adjacent the plane containing its maximum internal diameter. The preferred location of the perforated area is in a region remote from the walls of the grinding chamber, and adjacent the axis of symmetry. The optimum axial location of the perforated area is not precisely defined, and may vary about the plane containing the maximum chamber diameter by an amount of typically 25 percent of the maximum internal chamber diameter.

Another feature of a preferred embodiment of the invention is that the fine product flows through the perforated area of the screening element, and discharges from an end of the grinding chamber remote from the point of nutation symmetry. Discharge of product from the grinding chamber in this embodiment is enhanced by the high inertial acceleration effect of the chamber motion. This ensures a relatively high flowrate capacity per unit of area of discharge openings.

A feature of another preferred embodiment of the invention is that the fine product flows through the perforated area of the screening element, and discharges from the grinding chamber through a tubular passage which passes through the feed opening adjacent the point of nutation symmetry. With this discharge configuration, flow of fine product is induced through the perforated area to a tubular flow passage, and out of the grinding chamber, by a pump device which provides a pressure gradient along the flow passage. In this embodiment, the axial location of the perforated area may vary typically from adjacent the plane containing the grinding chamber maximum internal diameter to a position approaching the entry of the feed passage to the chamber. The higher position of the perforated area in the grinding chamber has the advantage of requiring a reduced unsupported length of the tubular passage.

In a preferred embodiment of the invention constraint means comprising annular bearing surfaces associated with the grinding chamber engage complementary opposing bearing surfaces on the support member, said annular bearing surfaces comprising a spherical bearing symmetrical about the point of nutation symmetry, and adapted to limit the amplitude of nutating motion.

In another embodiment of the invention, rotation of the grinding chamber about its axis of symmetry is prevented by a torque-restraining device connecting the grinding chamber to the support member.

In a preferred embodiment of the invention, the driving means comprises a drive shaft having an axis substantially co-linear with the stationary axis of nutating motion, mounted in bearings for rotation, and driven in rotation from an end remote from the grinding chamber by a power transmission unit connected therewith. The drive shaft is provided with a cantilevered eccentric stub shaft mounted at the end adjacent the grinding chamber, the stub shaft having an axis substantially co-linear with the axis of symmetry of the grinding chamber. The eccentric stub shaft engages the grinding chamber through an intermediate bearing element adapted to permit relative rotational motion about the chamber axis of the two engaging members.

BRIEF DESCRIPTION OF THE DRAWINGS

In order to achieve a better understanding of the nature of the present invention a preferred embodiment of a centrifugal grinding mill will now be described in some detail, by way of example only, with reference to the accompanying drawings in which.

DETAILED DESCRIPTION OF THE PREFERRED EMBODIMENT

Figure 1:
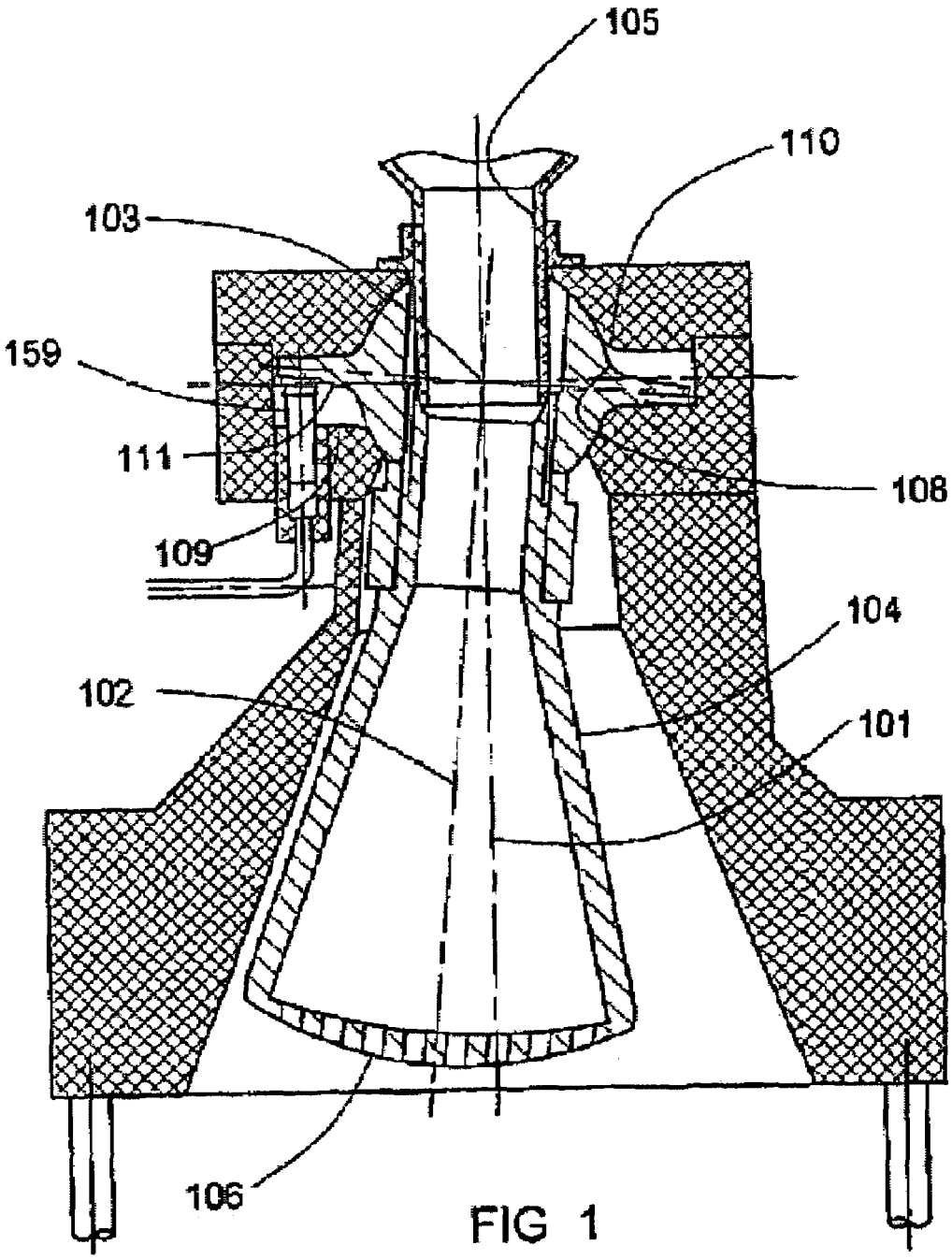
FIG 1 PRIOR ART
FIGS. 1 and 2 are sectional views of prior art centrifugal grinding mills.
Figure 2:
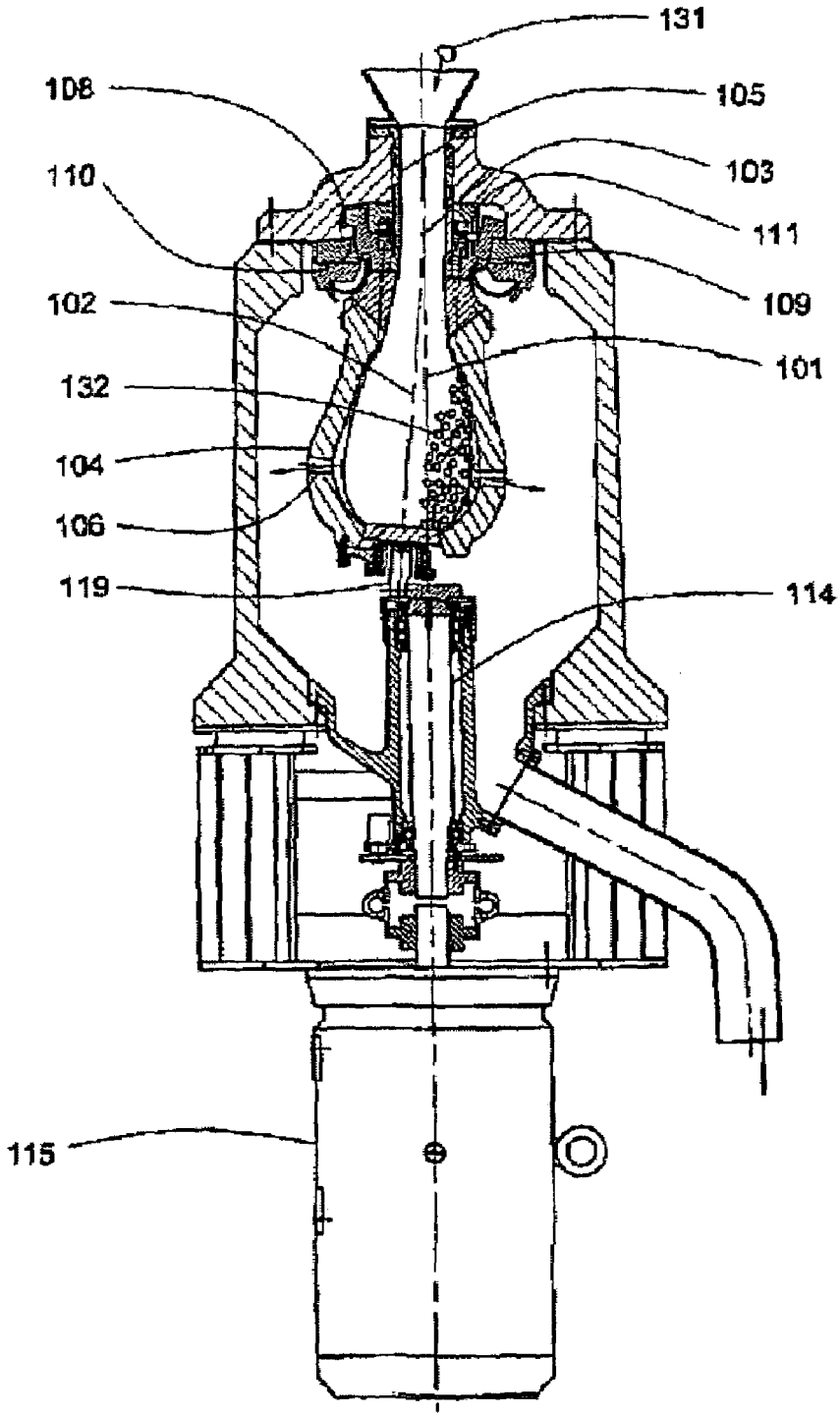
FIG 2 PRIOR ART
Figure 3:
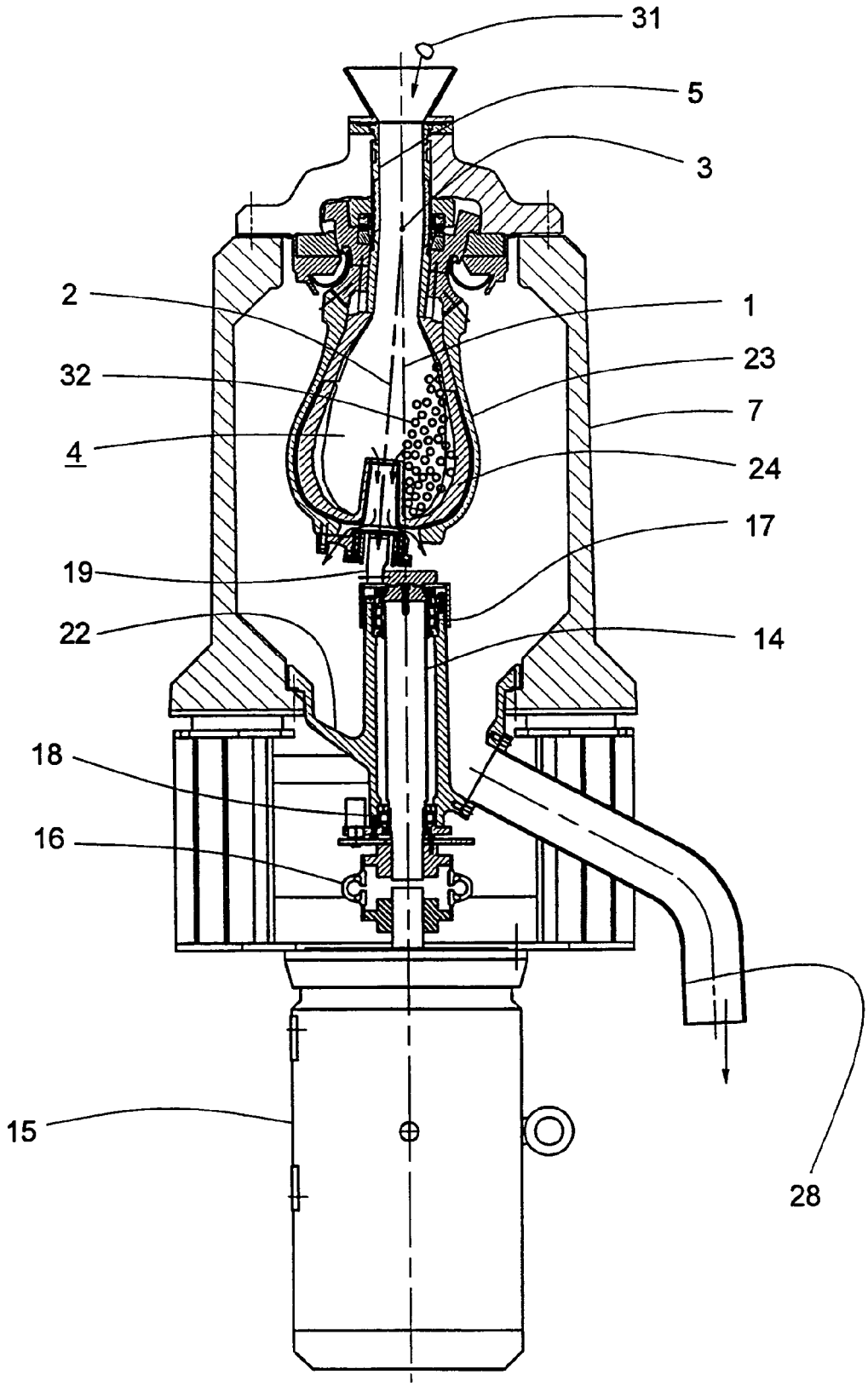
FIG. 3 is a sectional view of a centrifugal grinding mill according to one embodiment of the invention.
Figure 4:
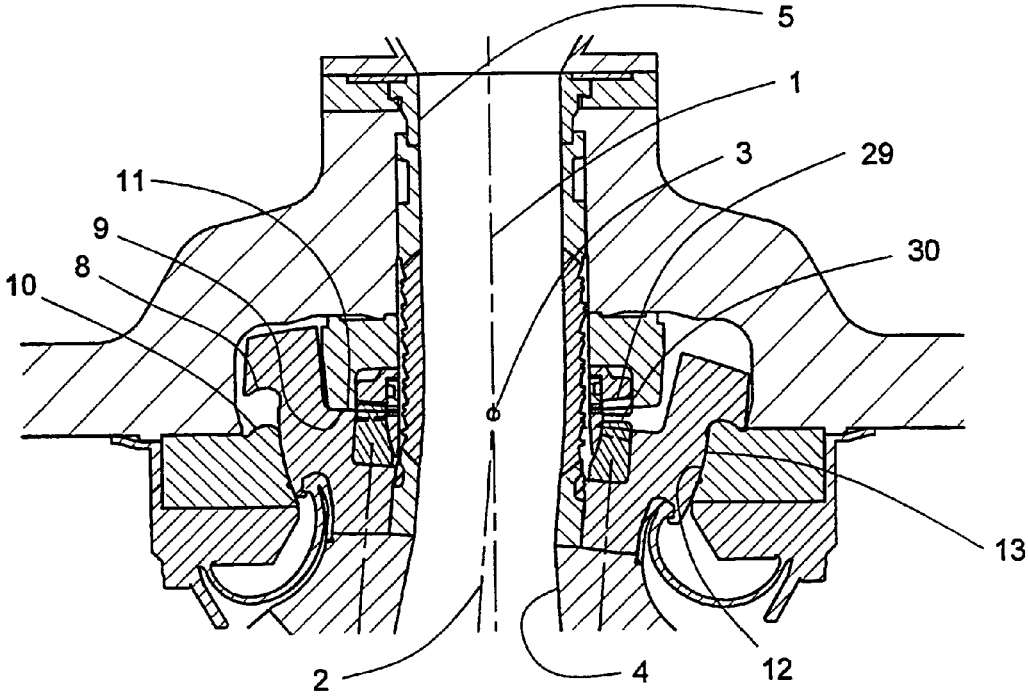
FIG. 4 is an enlarged sectional view of constraint means of the grinding mill of FIG. 3.
Figure 5:
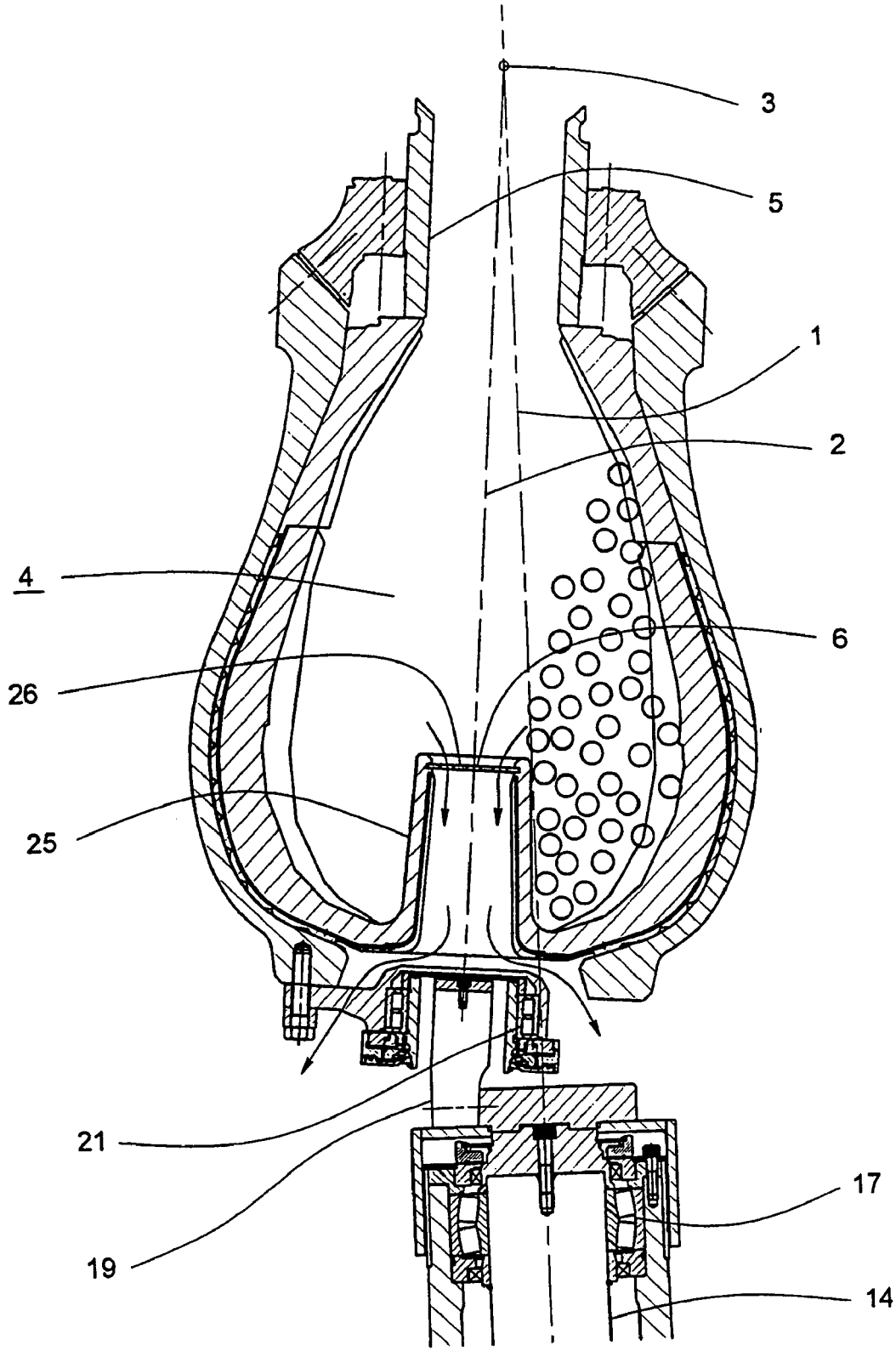
FIG. 5 is an enlarged sectional view of the drive end of a grinding chamber of the grinding mill of FIG. 3.

As best shown in FIGS. 3 to 5 there is one embodiment of a centrifugal grinding mill comprising:

a vertical axis of revolution 1, a nutating axis 2 intersecting axis 1 at a point of nutation symmetry 3, a grinding chamber 4 symmetrical about axis 2 connecting with feed passage 5 at its upper end and having discharge openings 6 of a screening element 26 located within a plane area aligned normal to, symmetrical with, and intersected by the axis 2, and adjacent the plane containing the maximum diameter of the grinding chamber 4, support means comprising a frame member or members 7 adapted to support the mill and transmit forces and moments generated by the mill to suitable foundations, constraint means for determining the form of nutating motion of the grinding chamber comprising annular nutating bearing surfaces 8 and 9 rolling on corresponding fixed bearing surfaces 10 and 11 and nutating and fixed part spherical surfaces 12 and 13 respectively having centres coincident with the point of symmetry 3, and drive means located below the grinding chamber 4 comprising a drive shaft 14 adapted to be driven at its lower end by an electric motor 15 or other power transmission device through a flexible drive coupling 16, said drive shaft 14 supported at its upper and lower ends by bearings 17 and 18 respectively which are mounted in a support member 46 attached to frame member 7, the said drive shaft 14 having an eccentric stub shaft 19 mounted at its upper end, with the stub shaft axis 20 held coincident with nutating axis 2 by engagement of the stub shaft 19 with bearing 21 mounted at the lower extremity of the grinding chamber 4.

The feed passage 5 intersects the inner surface of the grinding chamber 4, and its upward extension, at a plane which defines the upper boundary of the grinding chamber, located below the point of nutation symmetry 3.

In the embodiments shown in FIGS. 3 and 5, the grinding chamber 4 is depicted as comprising an outer metal casing 23, and an inner replaceable liner 24 of elastomer construction. Other variant forms of grinding chamber may be used, including a grinding chamber of moulded elastomer construction, without an outer metal casing. FIG. 5 shows a tubular extension 25 from the drive end of the grinding chamber 4, symmetrical about the nutating axis 2, which extends into the interior of the chamber to a region adjacent the plane of maximum diameter of the chamber inner wall. The screening element is in the form of a perforated plate 26, or discharge grate, typically of plane circular form, which is adapted to fit in a matching groove near the open end of the tubular extension 25 from the drive end of the grinding chamber 4. The plate 26 is perforated with a closely spaced pattern of openings 6, typically of circular or elongated slot form. The openings 6 in the plate 26 are closely spaced, to provide maximum area of opening for flow through the plate 26, whilst providing sufficient structural strength to resist deformation from loads applied by impact from particles of grinding media or large particles. The openings 6 may typically occupy 40 to 50 percent of the exposed area of the plate 26.

A feature of this configuration of the plate 26 or discharge grate is that the plane surface of the plate 26 is substantially parallel to the direction of motion of the grinding chamber 4 contents, comprising grinding media and feed material. Hence surface pressures at the plate surface, and associated abrasive wear effects are minimised. This configuration of the discharge grate 26 is particularly favourable for grinding to fine product sizes. Fine grinding applications require very small openings in the perforated plate or discharge grate, which is not consistent with high mechanical strength. The relatively low surface pressures associated with this configuration of discharge grate is compatible with its reduced mechanical strength in fine grinding applications. The discharge of fine material passing the discharge grate in the embodiment shown in FIGS. 3 and 5 is assisted by the inertial effects of the nutating chamber motion, which dynamically expels the material from the interior of the tube 25. This contributes to a high unit flowrate capacity of the plate 26 or the discharge grate area.

Figure 6:
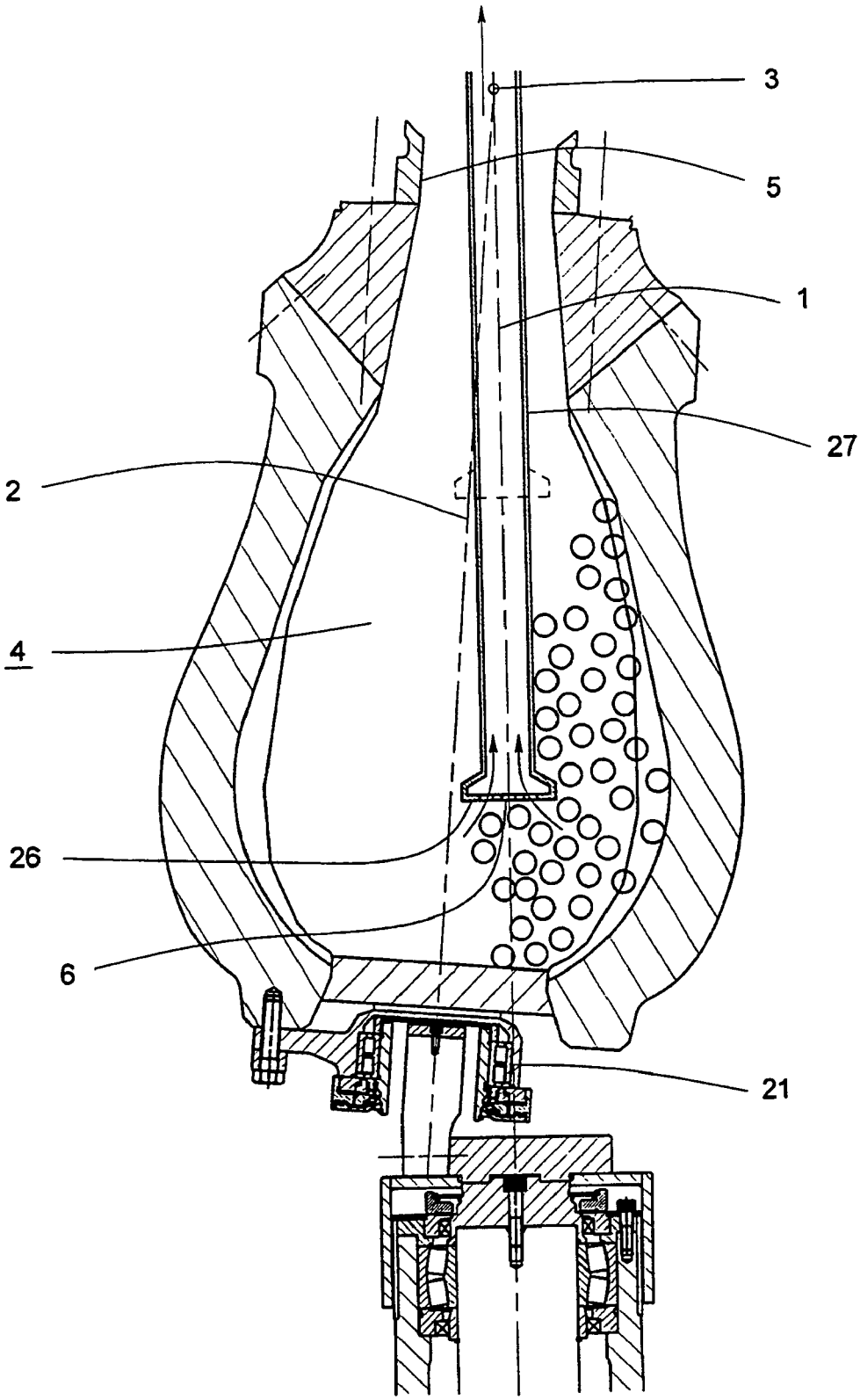
FIG. 6 is an enlarged sectional view of a grinding chamber of a centrifugal grinding mill of another embodiment of the invention.

In another embodiment of the invention, shown in FIG. 6, the screening element, or discharge grate 26, is attached to a tubular member 27, which is separate from the grinding chamber 4, and supported independently thereof. In this embodiment, the tubular member 27 is typically stationary, and enters the grinding chamber through the feed passage 5, extending into the grinding chamber 4 to the region of the plane of maximum diameter of the chamber internal surface. It has been found advantageous to provide for adjustment of the axial location of the perforated area 26 along the vertical axis of revolution 1. In this case the preferred location of the perforated area lies in a range from adjacent the plane of maximum internal diameter of the grinding chamber 4 to a position where minimum radial clearance is provided with the internal surface of the chamber 4, typically not less than one third the diameter of the feed passage 5, as indicated in FIG. 5. Fine product material is induced through the discharge grate openings and into the passage of the connecting tubular member 27 by the effect of a pressure gradient applied by a pump device (not shown) connected to the other end of the tubular member 27, located outside the grinding chamber 4. In this embodiment the discharge grate 26' and tubular member 27 are typically supported independently of the nutating grinding chamber 4.

In one form of this alternative embodiment, the stationary tubular member 27 is a rigid element which is supported at a position outside the grinding chamber 4, and extends into the interior of the chamber 4. In another form of this embodiment, the tubular member 27 is of a flexible construction, typically of reinforced elastomer, and supported at a position outside the grinding chamber 4. The tubular member 27 extending into the chamber 4 is free to deflect as determined by the loading applied by contact with the grinding media 32 and feed particles 31. The flexible tubular member 27 may be provided with helically wound reinforcing to resist torsional wind-up under the effects of torsional moment applied to the tubular member 27 from the grinding media 32 and feed particles 31.

The use and operation of these embodiments of the invention will now be described with reference to the accompanying figures. In operation of the centrifugal grinding mill shown in FIG. 3, the input drive shaft 14 is driven in rotational motion by the drive motor 15, which is converted to nutating motion of the drive chamber 4 by its interaction with the eccentric stub shaft 19, and the constraint means, comprising opposing bearing surfaces 8 and 10, and 9 and 11, disposed about the point of nutation symmetry 3. Solid feed particles 31 are fed into the feed passage 5, where they move by gravity to the grinding chamber 4. The feed particles 31 interact with loose solid particles of grinding media 32, or with other coarse particles of feed material, which are driven with a gyrating and tumbling action by the motion of the grinding chamber 4, causing the feed particles 31 to break down to finer size fractions. In some grinding applications, separate particles of grinding media 32 are not used, and breakage of particles to finer sizes is fully dependent on particle-to-particle, and particle-to-wall interactions. Fine size fractions of feed particles 31 discharge from the grinding chamber 4 through openings 6 in the screening element or discharge grate 26.

The embodiment shown in FIG. 3 is a wet grinding mill, in which liquid, usually water, is also introduced into the grinding chamber 4 with solid feed particles 31. In the embodiment shown in FIGS. 3 and 5, ground material finer than the dimension of discharge openings 6 pass through the discharge openings to the tubular extension 25 of the grinding chamber 4, from which they discharge at the lower end adjacent the drive mechanism. All material coarser than the size of discharge openings 6 is retained within the grinding chamber 4 where it undergoes further size reduction. Fine product material discharges from the lower end of the discharge chamber tube 25 in the form of a slurry, and drains to a central sump 22 surrounding the drive shaft 14, from where it flows to discharge pipe 28.

In the alternative embodiment shown in FIG. 6, the screening element or perforated plate 26 is fixed to a stationary tubular member 27, which enters the grinding chamber 4 through the feed passage 5. Ground material finer than the size of discharge openings 6 are induced to flow through the openings and into the tubular member 27 by the application of a pressure gradient across the ends of the tubular member 27, typically by means of a pump connected to the external end of the tubular member 27. Product material flows vertically upwards in the tubular member 27 and discharges to a location external to the grinding chamber 4. Other embodiments may also include centrifugal grinding mills adapted for operating with a dry environment within the grinding chamber 4. In this case gas, usually air, is fed to the grinding chamber together with feed particles 31, and discharge product issues from the openings 6 as a suspension of fine particles in gas.

The grinding chamber 4, and attached members, are located and constrained to perform the required nutating motion about the vertical axis 1 by continuous rolling contact at opposing bearing surface pairs 8 and 10, and 9 and 11 of the constraint means, as shown in FIG. 4. All inertial reactions from the assembly of nutating members, as a consequence of their nutating motion, are transmitted to the support frame 7 via stationary bearing surfaces 10 and 11.

The driving means, below the grinding chamber 4, are isolated from the inertial reactions of the chamber 4 by the resilient mounting of bearing 21, connecting the driving means and grinding chamber, relative to the grinding chamber 4 or the stub shaft 19.

In addition to providing energy transfer from the power input unit 15 to the grinding chamber 4, an important function of the drive mechanism, shown in FIG. 3, is to prevent ingress of discharge products to the bearings, and other drive components. It is a feature of this type of centrifugal grinding mill that the regions surrounding and below the grinding chamber 4 are permeated by slurry discharging from the grinding chamber 4. The slurry discharges with high velocity, impacting on, and rebounding as a dispersion of slurry particles, from the internal surface of the frame member 7, creating a zone of intensely turbulent high velocity particles of slurry. The maintenance of long term continuous operation of the grinding mill requires that the drive mechanism, located within this region of high velocity slurry particles, has effective sealing means to exclude all slurry contamination from the bearing cavities.

The embodiments shown in the accompanying figures describe a centrifugal grinding mill in which the grinding chamber 4 is restrained from rotation about the vertical axis 1 by intermeshing bevel gears 29 and 30 disposed about the point of the nutation symmetry 3, as shown in FIG. 4. Gear 30 fixed to the grinding chamber 4, has nutating motion, and engages with stationary gear 29, to transfer torsional moment from the grinding chamber 4 to the stationary frame 7. It is to be understood that the invention is not limited to centrifugal grinding mills having grinding chambers restrained from rotation, and may also be applied to alternative embodiments in which the grinding chamber is free to rotate about the nutating axis 2. In such alternative embodiments, it is common for the rotational speed of the grinding chamber 4 about its axis to be a small proportion, typically about two percent, of the nutating speed of the mill.

In the embodiment shown in the accompanying figures, lubrication of bearings 17, 18, and 21 is provided by lubricant which is continuously recirculated through interconnecting passages in the rotating shaft elements, including 14 and 19. The recirculating lubricant provides cooling to remove excessive heat generated in bearings, and also removes contamination resulting from bearing wear and entry of any particles. Lubricant discharging from the bearings is subsequently filtered to remove contaminants, and cooled by heat exchange equipment, if required, prior to recirculating to the bearings.

Those skilled in the art will appreciate that the invention described herein is susceptible to variations and modifications other than those specifically described.

All such variations and modifications are to be considered within the scope of the present invention the nature of which is to be determined from the foregoing description.

For the purposes of this specification it is to be understood that the word "comprising" means "including but not limited to", and that the word "comprises" has a corresponding meaning.

It is to be understood that, if any prior art publication is referred to herein, such reference does not constitute an admission that the publication forms a part of the common general knowledge in the art, in Australia or any other country.

The invention claimed is:

1. A centrifugal grinding mill comprising:

a grinding chamber having a longitudinal axis of symmetry, the grinding chamber being constrained and adapted to permit nutating motion of the axis of symmetry about a relatively stationary axis of the grinding mill, said axes intersecting at a point of nutation symmetry;

a support member on which the grinding chamber is supported;

a feed passage in communication with and directed towards the grinding chamber;

driving means operatively coupled to the grinding chamber, and designed to drive the grinding chamber to effect the nutating motion; and a screening element located internally of the grinding chamber and being configured to permit particles of ground product to discharge from the chamber, wherein the screening element includes a screening surface oriented substantially normal to the longitudinal axis of the grinding chamber wherein ground product is discharged from the chamber in a generally axial direction.

2. A centrifugal grinding mill as defined in claim 1 wherein discharge occurs in a region adjacent the axis of symmetry of the chamber, said region being associated with reduced impact pressures and corresponding reduced abrasive wear.

3. A centrifugal grinding mill as defined in claim 2 wherein the screening element includes a member having a perforated area disposed symmetrically about the axis of symmetry of the grinding chamber.

4. A centrifugal grinding mill as defined in claim 3 wherein the member is a planar member having a perforated plane area aligned normal to, and symmetrical with, the axis of symmetry of the grinding chamber.

5. A centrifugal grinding mill as defined in claim 4 wherein the perforated area of the screening element is located symmetrically about the axis of symmetry of the grinding chamber, and approximately adjacent an imaginary plane containing its maximum internal diameter.

6. A centrifugal grinding mill as defined in claim 5 wherein the perforated area of the screening element is located in a region remote from the walls of the grinding chamber, and adjacent the axis of symmetry.

7. A centrifugal grinding mill as defined in claim 6 wherein the perforated area is axially located relative to the imaginary plane containing the maximum chamber diameter at a position which varies by about 25 percent of the maximum internal chamber diameter.

8. A centrifugal grinding mill as defined in claim 3 wherein the said perforated area comprises closely spaced circular openings in a surface of the screening element.

9. A centrifugal grinding mill as defined in claim 3 wherein the said perforated area comprises closely spaced openings of elongated slot form in a surface of the screening element.

10. A centrifugal grinding mill as defined in claim 1 wherein the ground product flows through of the screening element, and discharges from an end of the grinding chamber remote from the point of nutation symmetry.

11. A centrifugal grinding mill as defined in claim 1 further comprising constraint means including annular bearing surfaces associated with the grinding chamber and designed to engage complementary opposing bearing surfaces on the support member.

12. A centrifugal grinding mill as defined in claim 11 wherein said annular bearing surfaces comprising a spherical bearing disposed symmetrically about the point of nutation symmetry, and adapted to limit the amplitude of nutating motion.

13. A centrifugal grinding mill as defined in claim 1 wherein the relatively stationary axis is substantially vertical and the feed passage is downwardly directed to the grinding chamber.

14. A centrifugal grinding mill as defined in claim 1 further comprising a torque-restraining device connecting the grinding chamber to the support member and being designed to prevent rotation of the grinding chamber about its axis of symmetry.

15. A centrifugal grinding mill as defined in claim 1 wherein the driving means comprises a drive shaft having an axis substantially co-linear with the stationary axis of nutating motion.

16. A centrifugal grinding mill as defined in claim 15 wherein the drive shaft is mounted in bearings for rotation, and driven in rotation from an end remote from the grinding chamber by a power transmission unit connected therewith.

17. A centrifugal grinding mill as defined in claim 16 wherein the drive shaft is provided with a cantilevered eccentric stub shaft mounted at the end adjacent the grinding chamber, the stub shaft having an axis substantially co-linear with the axis of symmetry of the grinding chamber.

18. A centrifugal grinding mill as defined in claim 17 wherein the eccentric stub shaft engages the grinding chamber through an intermediate bearing element adapted to permit relative rotational motion about the chamber axis of the two engaging members.

19. A centrifugal grinding mill comprising:

a grinding chamber having a longitudinal axis of symmetry, the grinding chamber being constrained and adapted to permit nutating motion of the axis of symmetry about a relatively stationary axis of the grinding mill, said axes intersecting at a point of nutation symmetry;

a support member on which the grinding chamber is supported;

a feed passage in communication with and directed towards the grinding chamber;

driving means operatively coupled to the grinding chamber, and designed to drive the grinding chamber to effect the nutating motion; and a screening element located internally of the grinding chamber and being configured to permit particles of ground product to discharge from the chamber, wherein the ground product flows through of the screening element, and discharges from the grinding chamber through a tubular passage which passes through the feed passage adjacent the point of nutation symmetry.

20. A centrifugal grinding mill as defined in claim 19 wherein the mill is adapted to enable ground product to flow in the tubular passage by the application of a suitable pressure gradient along said passage.

21. A centrifugal grinding mill as defined in claim 20 wherein the tubular passage and the screening element are supported independently of the grinding chamber.

22. A centrifugal grinding mill as defined in claim 21 wherein the mill is configured to permit adjustment of the tubular passage and the screening element along the relatively stationary axis.

23. A centrifugal grinding mill as defined in claim 22 wherein the axial location of the screening element varies from adjacent an imaginary plane containing the grinding chamber maximum internal diameter to a position approaching the entry of the feed passage to the chamber.

* * * * *